US006973863B1

(12) United States Patent
Jones

(10) Patent No.: US 6,973,863 B1
(45) Date of Patent: Dec. 13, 2005

(54) ADAPTOR FOR FIRING BLANK AMMUNITION

(75) Inventor: Corey L. Jones, Lugoff, SC (US)

(73) Assignee: FN Herstal, Herstal Beligique (BE)

( * ) Notice: Subject to any disclaimer, the term of this patent is extended or adjusted under 35 U.S.C. 154(b) by 0 days.

(21) Appl. No.: 10/386,825

(22) Filed: Mar. 12, 2003

(51) Int. Cl.[7] ..... F41A 21/34
(52) U.S. Cl. ..... 89/14.2
(58) Field of Search ..... 89/14.2, 14.4, 89/29, 14.5; 42/77

(56) References Cited

U.S. PATENT DOCUMENTS 2,108,026 A * 2/1938 Sutter et al. ..... 89/132
3,744,370 A * 7/1973 Snodgrass ..... 89/14.5
3,766,822 A * 10/1973 Sophinos ..... 89/14.5
4,638,714 A * 1/1987 Heintz et al. ..... 89/37.01
4,893,426 A * 1/1990 Bixler ..... 42/75.01
4,939,977 A * 7/1990 Stroup ..... 89/14.5
4,947,729 A * 8/1990 Downey ..... 89/14.4
6,026,728 A * 2/2000 Guhring et al. ..... 89/14.5
6,176,032 B1 * 1/2001 Cohen et al. ..... 42/96

FOREIGN PATENT DOCUMENTS

CH 381569 * 10/1964 ..... 89/14.5
DE 687 392 * 1/1940 ..... 89/14.5

* cited by examiner

*Primary Examiner*—Stephen M. Johnson
(74) *Attorney, Agent, or Firm*—Michael A. Mann; Nexsen Pruet, LLC

(57) ABSTRACT

An adaptor for use with a flash suppressor on a gun barrel in order to allow the gun to repeatedly fire blank rounds of ammunition. The adaptor has a stem that chokes the flow of gases from an exploding round in order to create a back pressure. A body is used to couple the stem to the flash suppressor and permit a cap to be threaded to the body. The cap urges the stem into the throat of the flash suppressor when tightened to the body while the body grips the flash suppressor to hold the stem and cap in place. Belleville washers in the cap pre-loaded and urge the stem into the throat and hold it there securely during repeating firing of the gun.

15 Claims, 4 Drawing Sheets

ADAPTOR FOR FIRING BLANK AMMUNITION

CROSS-REFERENCE TO RELATED APPLICATIONS

Not applicable

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

So-called "blank" ammunition consists of shell casings loaded with gun power or other explosive but without projectiles. When fired, a blank round sounds much like "live" ammunition but, unlike live ammunition, no projectile leaves the barrel of the gun in which the blank was fired. Blank ammunition is used extensively in military training for safety reasons.

In the case of a gas operated automatic rifle or machine gun a portion of the gas pressure created inside a gun's barrel by the ignition of a cartridge is diverted through a small hole in the barrel to be utilized for the operation of the gun's mechanism that ejects the spent cartridge case and loads a live one from the gun's magazine. In the case of the firing of a "blank" there is less gas pressure built up in the barrel because there is no projectile being forced through the barrel. The lower gas pressure in the barrel causes the diverted gas to be of too low a pressure to properly operate the gun's ejection and loading mechanism. Typically, an adapter is fitted onto the end of the barrel that restricts the flow of gas and increases the pressure in the barrel to a level that equals the pressure created when a "live" cartridge is fired. Thus the adapter allows a gun firing blank ammunition to operate in the same way as the gun would when firing "live" ammunition.

Existing blank adapters were designed to work with older model machine guns such as the M240, which normally operate under moderate firing schedules. There is a significant and adverse impact on the life of the older design of the blank firing adapter when used on newer, shorter and lighter weight machine guns, such as the Mark 48. The newer, lighter guns operate at accelerated firing schedules and are configured with shorter and lighter barrels, which create increased temperatures. The increased temperatures seen at the muzzle of newer lightweight guns damage the blank adapter made to the older design. The temperatures developed at the muzzle end of the barrel exceed the design parameters for the older blank firing adapter and consequentially reduce its life from 7,000 rounds to 500 rounds. This diminution of blank firing adapter life is unacceptable for its use on a new type machine gun.

Another problem with blank firing adapters is that as the muzzle end of the barrel heats up, the blank firing adapter heats unevenly, causing the adapter to loosen. When the adapter loosens, gas escapes around the tapered end of the stem, causing a reduction in pressure inside the barrel and damage to the adapter. The reduction in pressure consequently reduces the amount of diverted gas below the level required for the proper operation of the gun's mechanism.

When it loosens the operator must stop and re-tighten the adapter using a special tool. Typically, re-tightening the existing adapter on an older style gun is required around 1,000 rounds. For a new style gun it is required almost immediately.

ADAPTOR

Ideally, there would be an adaptor for a barrel of a machine gun of either the older or newer design that allows it to fire blank ammunition in a manner similar to that of live ammunition but without damage to or loosening of the adaptor. Such an adaptor should also be easier to maintain and not require special tools for installation or tightening.

SUMMARY OF THE INVENTION

Briefly recited and according to its major aspects, the present invention is an adaptor for use with a machine gun. The present adaptor comprises a stem that is dimensioned to fit into the machine gun barrel, thus reducing its effective barrel internal diameter in order to create sufficient backpressure, a body that grips the barrel and surrounds the stem, and a cap that holds the stem securely to the body. The cap also includes a set of Belleville washers arranged to hold the stem in a preloaded condition against the flash suppressor so that tightening during use is not required.

An important feature of the present invention is the use of the Belleville washers to help hold the stem firmly in place in the barrel of the machine gun. As a result, the present adaptor enables a barrel of a newer machine gun to fire 7000 rounds or more.

Another important feature of the present invention is the pair of opposing faces formed on the cap that can receive the jaws of the same wrench that tightens the gas regulator. Thus, one wrench can be used to install the blank adaptor and the gas regulator; no additional wrench is required.

These and other features and their advantages will be apparent to those skilled in the art of firearms from a careful reading of the Detailed Description of Preferred Embodiments accompanied by the following drawings.

DETAILED DESCRIPTION OF PREFERRED EMBODIMENTS

The present invention is a blank adaptor for use with a machine gun. The adaptor is intended to create a sufficient backpressure in the barrel of a gun for use in ejecting a fired cartridge and chambering a subsequent round of ammunition. While the present blank adaptor embodiment has particular utility with a US military machine gun designated as the Mark 48, it is also suitable for use with other machine guns and indeed guns other than machine guns with only minor modifications in dimensions.

Figure 1:
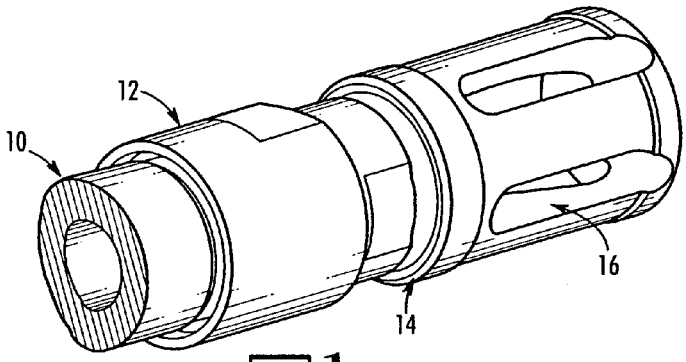
FIG. 1 PRIOR ART
FIG. 1 illustrates in perspective the end of a barrel of a machine gun with a typical flash suppressor on the end, according to the prior art.

FIG. 1 illustrates a portion of a prior art gun barrel with a flash suppressor attached to the end thereof. Neither the barrel nor the flash suppressor is part of the present invention. However, the present invention is made to be used with a barrel having a feature on the end thereof, such as the flash suppressor shown, that provides a gripping surface, preferably one lying in the plane defined by the barrel's axis and facing rearward, that is, away from the muzzle end of the barrel.

Figure 2:
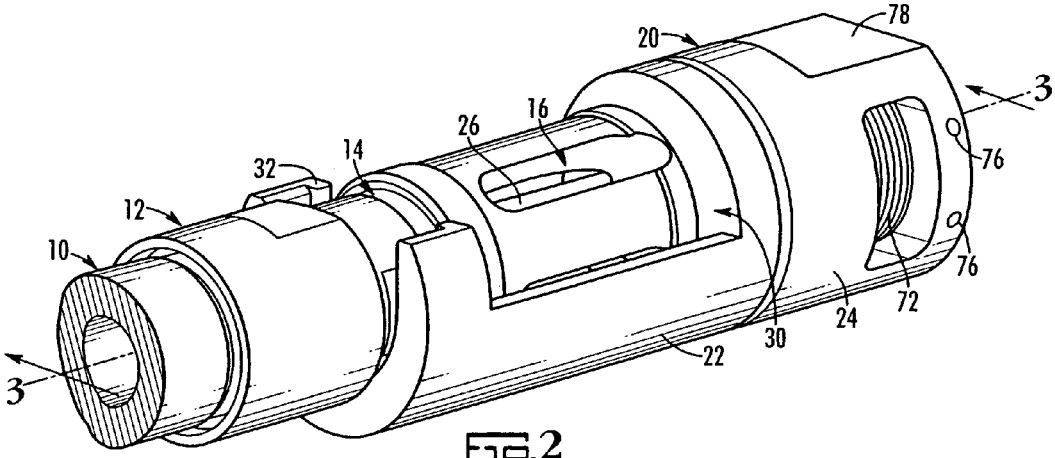
FIG. 2 illustrates in perspective the end of a barrel of the same machine gun with its flash suppressor and having a blank adaptor according to a preferred embodiment of the present invention attached thereto.
Figure 3:
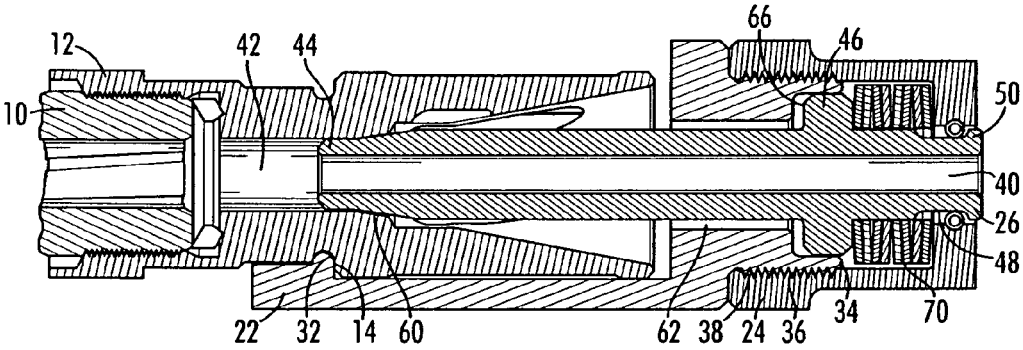
FIG. 3 is a cross sectional view of the barrel, flash suppressor and blank adaptor of FIG. 2, taken along lines 3—3.
Figure 4:
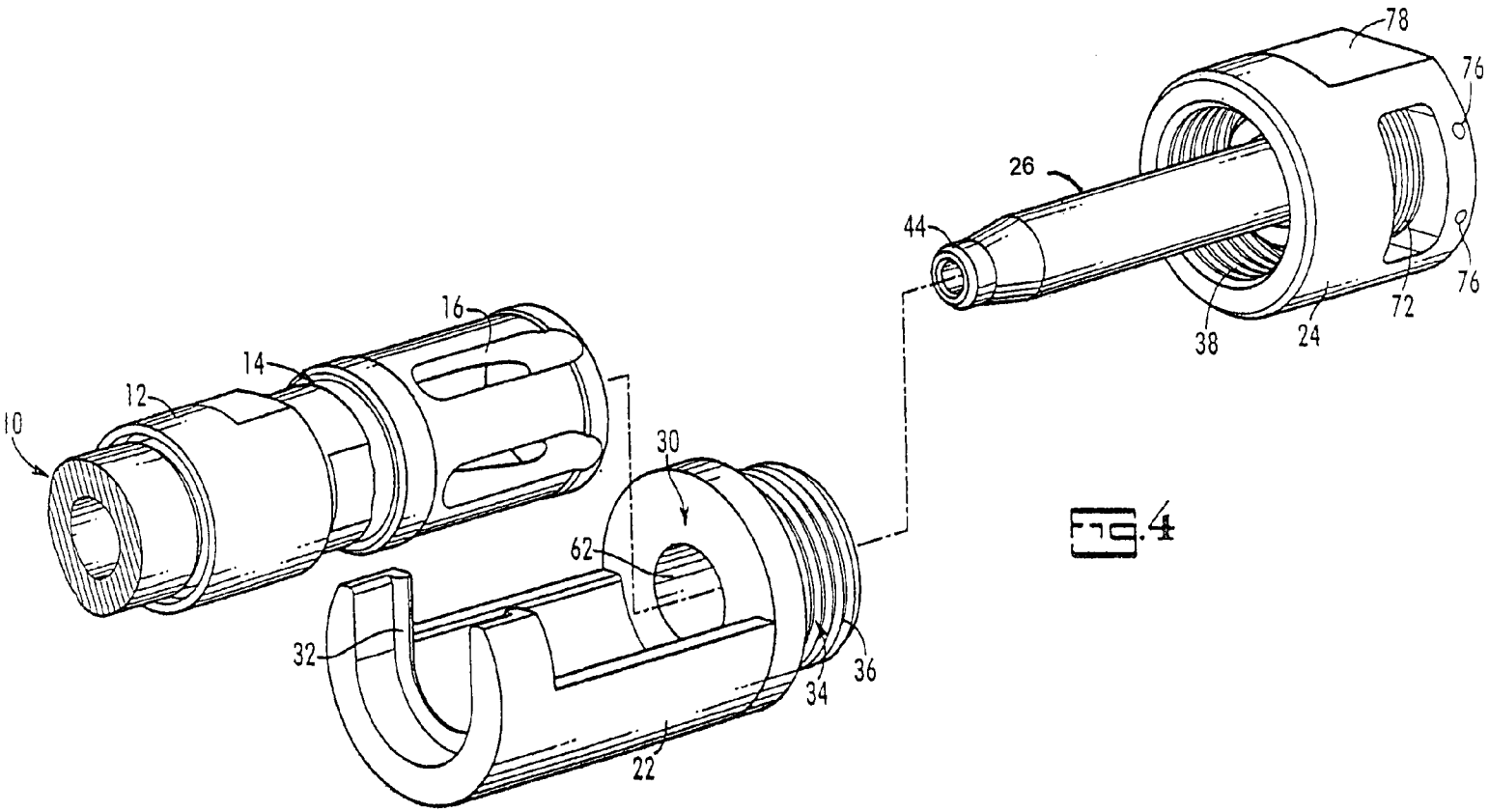
FIG. 4 is a partially exploded view of the barrel, flash suppressor and blank adaptor shown in FIG. 2.
Figure 5:
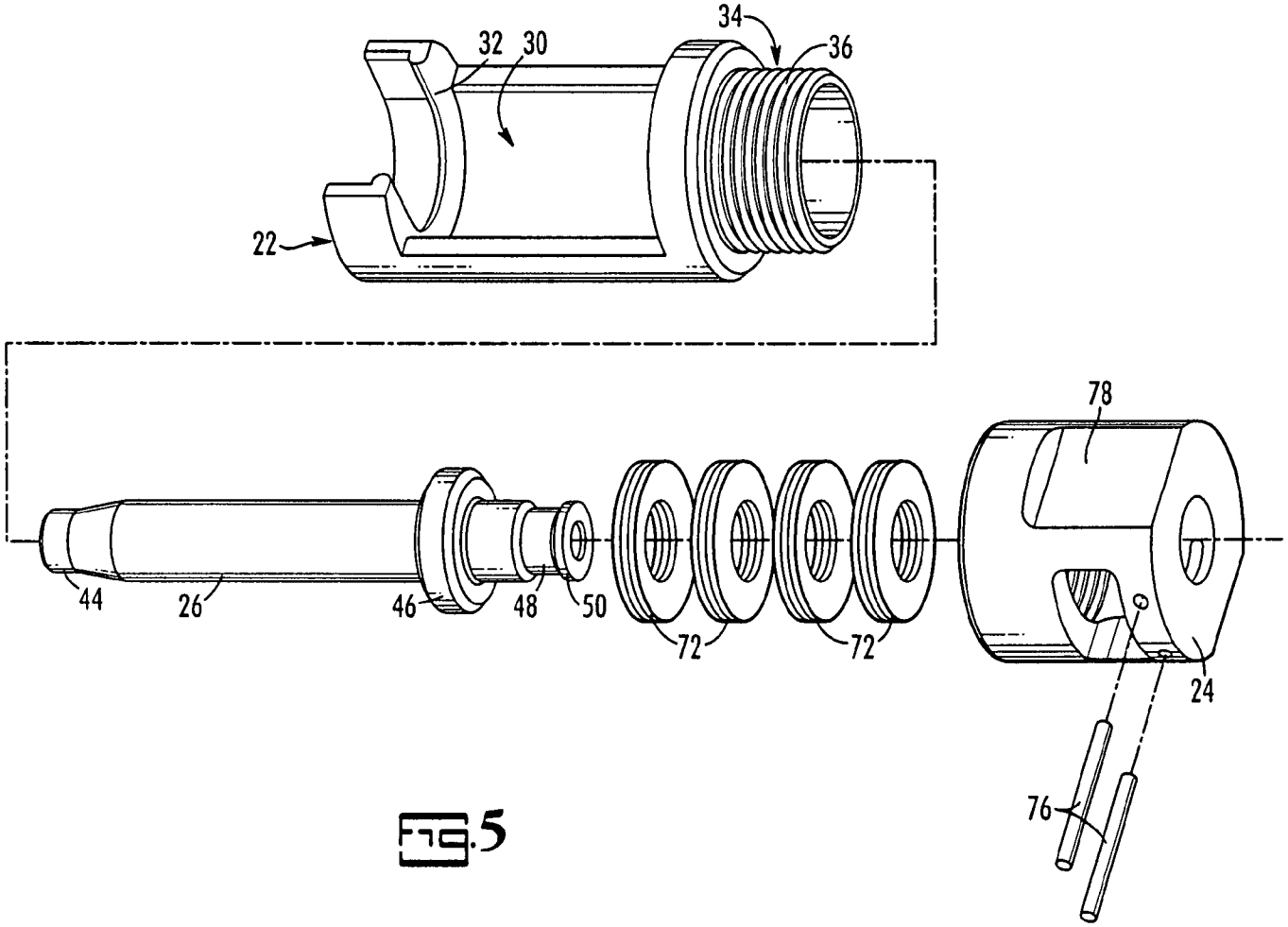
FIG. 5 is an exploded view of the blank adaptor, according to a preferred embodiment of the present invention.

FIG. 1 shows a barrel 10 with a flash suppressor 12 having a rear surface 14 and plural vent holes 16. FIG. 2 illustrates in perspective the same barrel 10 and flash suppressor 12 as shown in FIG. 1. Additionally, FIG. 2 shows a blank adaptor 20 attached to flash suppressor 12. FIGS. 3–5 illustrate various details of how the present blank adaptor 20 is constructed and installed on barrel 10 with flash suppressor 12.

Blank adaptor 20 includes a body 22 and a cap 24. Through the vent holes 16 of flash suppressor 12 a stem 26 is also visible, at least in part. Stem 26 is also part of blank adaptor 20. Body 22 has an opening 30 that allows it to be brought into engagement with flash suppressor 12 from the side rather than slipped over it from the end. Body 22 has a gripping flange 32 that extends radially inward of body 22 to couple to and engage rear surface 14 of flash suppressor 12, when body 22 is applied to flash suppressor 12. The engagement of gripping flange 32 and rear surface 14 is important to the operation of the present blank adaptor 20. The pressure of the gases from firing a blank round pushes forward, that is, toward the muzzle end of barrel 10 and therefore against blank adaptor 20. The engagement of these two components, namely, gripping flange 32 of body 22 and rear surface 14 of flash suppressor 12, resists this pressure and allows blank adaptor 20 to remain in place on barrel 10. Gripping flange 32 preferably extends approximately halfway around flash suppressor 12, as body 22 straddles flash suppressor 12, so that there is approximately 180° of contact between it and rear surface 14. Thus, body 22 can easily be installed on flash suppressor 12 from the side but nevertheless provides sufficient surface-to-surface contact between gripping flange 32 and rear surface 14 within that 180° of engagement.

Body 22 has a threaded end 34 opposite gripping flange 32. Threaded end 34 has external threads 36 that mate with internal threads 38 of cap 24. Cap 24 can thus be threadedly secured to body 22.

Stem 26 is hollow, with an internal bore 40 that is smaller in internal diameter than the internal bore 42 of barrel 10. Stem 26 has a tapered first end 44, a flange 46 and an annular recess 48 at a second end 50 that opposes first end 44. It will be clear from FIG. 3 that flash suppressor 12 has a tapered throat 60. Tapered first end 44 of stem 26 is dimensioned to match the taper of throat 60 of flash suppressor 12 for good fit. Stem 26, when tapered first end 44 is in full engagement with tapered throat 60, is long enough so that second end 50 extends from flash suppressor 12. The reduction in internal diameter between barrel 10 and stem 26, when stem 26 is in place in flash suppressor 12, chokes the path of escaping combustion gases and creates the backpressure required to chamber the next round.

Body 22 has an internal bore 62 dimensioned to receive second end 50 of stem 26, but bore 62 is not large enough to allow flange 46 of stem 26 to pass. Body 22 has an annular recess 66 dimensioned to receive flange 46, which is positionable between first end 44 and second end 50. Flange 46 interacts with features of cap 24, as will now be explained.

Cap 24 has a large internal bore 70 and carries internal threads 38. Internal bore is dimensioned to receive second end 50 of stem 26. Cap 24 contains plural washers 72, preferably eight spring washers or "Belleville" washers arranged in pairs. Washers 72 receive second end 50 and, when cap 24 is tightened, bear against flange 46, which is designed to distribute and transfer the load of the washers to stem 26. As cap 24 is threaded to threaded end 34 of body 22, stem 26 is urged against tapered throat 60 by the load applied on flange 46 by washers 72 in cap 24. Internal threads 38 of cap 24 hold cap 24 to external threads 36 of body 22, while body 22 is held securely by gripping flange 32 to rear surface 14 of flash suppressor 12. Washers 72 are formed to have a center in a different plane than their periphery so that they resist loosening but can be tightened and, when tightened, the two planes move together. Washers 72 are preferably arranged in opposing pairs; that is, one washer is oriented to oppose the other rather than to "nest" in the other.

Two pins 76 are inserted transverse to the axis of stem 26 and just off-axis so that they fit into annular recess 48 of second end 50. Pins 76 prevent axial movement of stem 26 beyond the axial limits of annular recess 48. Opposing flat surfaces 78 allow a wrench to be applied to cap 24 for tightening or loosening. Preferably, flat surfaces 78 are spaced apart a distance just sufficient for a gas regulator wrench so that the gas regulator wrench can be used to turn cap 24.

Those skilled in the art of firearms will readily appreciate that many substitutions and modifications can be made to the foregoing description of preferred embodiments without departing from the spirit and scope of the present invention, which is defined by the appended claims.

What is claimed is:

1. A device for use with a flash suppressor having a tapered throat, said device comprising:

means for choking a flow of gases from said flash suppressor;

a body adapted for gripping said flash suppressor; and a cap threadedly secured to said body and adapted for holding said choking means in said flash suppressor, said cap including at least one spring washer for urging said choking means into engagement with said tapered throat of said flash suppressor and said cap to said body when said body is coupled to said flash suppressor and said cap is secured to said body.

2. The device as recited in claim 1, wherein said at least one spring washer is at least one pair of spring washers.

3. The device as recited in claim 1, wherein said flash suppressor has a face and wherein said body has a flange oriented radially inward and adapted to engage said face of said flash suppressor.

4. A device for use with a flash suppressor having a tapered throat, said device comprising:

means for choking a flow of gases from said flash suppressor;

a body adapted for gripping said flash suppressor; and a cap threadedly secured to said body and adapted for holding said choking means in said flash suppressor, said cap including at least one spring washer for urging said choking means into engagement with said tapered throat of said flash suppressor and said cap to said body when said body is coupled to said flash suppressor and said cap is secured to said body, wherein said at least one spring washer is at least one pair of spring washers, each spring washer of said at least one pair of spring washers being oriented to oppose said other spring washer of said at least one pair of spring washers.

5. A device for use with a flash suppressor having a rearward face and a tapered throat, said device comprising:

a body having means formed thereon for engaging a rearward face of said flash suppressor and dimensioned to receive said flash suppressor therein;

a stem carried in said body and having a first end and an opposing second end, said first end being dimensioned to be receivable in said tapered throat of said flash suppressor; and a cap, said cap being threadedly secured to said body, said cap including at least one spring washer for urging a choking means into engagement with said tapered throat of said flash suppressor when said body is coupled to said flash suppressor and said cap is secured to said body.

6. The device as recited in claim 5, wherein said first end of said stem is tapered.

7. A device for use with a flash suppressor having a rearward face and a throat, said device comprising:

a body having means formed thereon for engaging a rearward face of said flash suppressor and dimensioned to receive said flash suppressor therein;

a stem carried in said body and having a first end and an opposing second end, said first end being dimensioned to be receivable in a throat of said flash suppressor; and a cap being threadedly secured to said body, said cap including at least one spring washer for urging a choking means into engagement with said flash suppressor when said body is coupled to said flash suppressor and said cap is secured to said body, wherein said at least one spring washer comprises at least one pair of spring washers, each spring washer of said at least one pair of spring washers being oriented to oppose another spring washer of said at least one pair of spring washers.

8. The device as recited in claim 7, wherein said at least one spring washer further urges said choking means into engagement with a flange of said body extending radially inward of said body.

9. The device as recited in claim 7, wherein said stem has a flange between said first end and said second end, and said at least one spring washer further comprises a spring means for urging said first end of said stem into said throat of said flash suppressor, said spring means bearing on a flange of said stem.

10. The device as recited in claim 7, wherein said second end has an annular recess formed therein and said cap has a hole formed transverse to the axis of said stem, said cap further comprising a pin inserted in said cap so that said pin rides in said annular recess.

11. The device as recited in claim 7, wherein said cap has opposing flat surfaces formed thereon and adapted to be gripped by a wrench.

12. A device for use with a flash suppressor, said device comprising:

a stem having a tapered first end and an opposing second end, said tapered end dimensioned to be received in said flash suppressor, said flash suppressor having a side and an end, said tapered first end of said stem being receivable in said end of said flash suppressor, said stem having a bore formed therein and dimensioned for choking the path of combustion gases escaping from said end of said flash suppressor and creating a back pressure required for chambering a next round;

a body adapted to grip said flash suppressor, said body having an opening formed therein and dimensioned to receive said side of said flash suppresser therein when said flash suppressor is brought into engagement with said body;

a cap threadably attached to said body, said cap having opposing faces formed thereon and adapted for receiving a wrench for tightening said cap to said body; and plural spring washers carried within said cap in engagement with said stem, said plural washers urging said stem into engagement with said end of said flash suppressor when said cap is tightened to said body and said body grips said flash suppressor.

13. The device as recited in claim 12, wherein said plural spring washers are sets of spring washers arranged in pairs of opposing spring washers.

14. The device as recited in claim 12, wherein said body has a flange, said flange being in engagement with said flash suppressor, and wherein said body is cylindrical and said opening leaves about 180° of contact between said flash suppressor and said flange of said body.

15. The device as recited in claim 12, further comprising means carried by said cap for limiting axial movement of said stem with respect to said cap.

* * * * *